US006897389B2

(12) United States Patent
Li

(10) Patent No.: US 6,897,389 B2
(45) Date of Patent: May 24, 2005

(54) ELECTRICAL SWITCH

(75) Inventor: Man Chi Li, Chaiwan (HK)

(73) Assignee: Defond Components Limited, Chaiwan (HK)

( * ) Notice: Subject to any disclaimer, the term of this patent is extended or adjusted under 35 U.S.C. 154(b) by 0 days.

(21) Appl. No.: 10/624,542

(22) Filed: Jul. 23, 2003

(65) Prior Publication Data

US 2005/0016826 A1 Jan. 27, 2005

(51) Int. Cl.[7] ..... H01H 3/12
(52) U.S. Cl. ..... 200/341; 200/302.2
(58) Field of Search ..... 200/302.1, 302.2, 200/341, 334

(56) References Cited

U.S. PATENT DOCUMENTS 4,395,608 A * 7/1983 Eicker et al. ..... 200/533
4,746,309 A * 5/1988 Durkop et al. ..... 439/471
4,877,930 A * 10/1989 Fukuma ..... 200/302.2
5,283,407 A * 2/1994 Pohl ..... 200/332
5,746,309 A * 5/1998 Neyer ..... 200/528
5,990,431 A * 11/1999 Wright ..... 200/302.3
6,198,058 B1 * 3/2001 Graninger et al. ..... 200/50.02
6,531,667 B2 * 3/2003 Becker et al. ..... 200/86.5
6,573,466 B1 * 6/2003 Rapp et al. ..... 200/302.3
6,626,473 B1 * 9/2003 Klein et al. ..... 292/347

FOREIGN PATENT DOCUMENTS

DE 3143900 * 5/1983 ..... 200/302.2

* cited by examiner

*Primary Examiner*—Elvin G. Enad
*Assistant Examiner*—Lisa Klaus
(74) *Attorney, Agent, or Firm*—Leydig, Voit & Mayer, Ltd.

(57) ABSTRACT

An electrical switch has a housing having an opening, fixed contacts located in the housing, a switching member supported in the housing for movement, and at least one moving contact movable by the switching member for movement to come into contact with and out of contact from the fixed contacts. An actuator is disposed in the opening for movement to actuate the switching member and in turn the moving contact. A gap is formed between the actuator and the opening that surrounds the actuator. A rubber deformable seal is connected across the opening and the actuator to seal off the gap, thereby avoiding entrance of foreign matter through the gap into the housing.

11 Claims, 3 Drawing Sheets

ELECTRICAL SWITCH

The present invention relates to an electrical switch for controlling the operation of an electrical appliance.

BACKGROUND OF THE INVENTION

Certain types of electrical switches are designed for use in environmentally adverse conditions such as factories and building/construction sites. Existing switches of the type generally referred to as "dust-proof" are often complicate in construction and/or to assemble, and therefore expensive.

The invention seeks to mitigate or at least alleviate such shortcomings by providing an improved electrical switch.

SUMMARY OF THE INVENTION

According to the invention, there is provided an electrical switch comprising a housing having an opening, a plurality of fixed contacts located in the housing, a switching member supported in the housing for movement, and at least one moving contact movable by the switching member for movement to come into contact with and out of contact from the fixed contacts. An actuator is disposed in the opening for movement to actuate the switching member and in turn the moving contact. A gap is formed between the actuator and the opening that surrounds the actuator. A resiliently deformable seal is connected across the opening and the actuator to seal off the gap, thereby avoiding entrance of foreign matter through the gap into the housing.

Preferably, the seal has an extended body length across the opening and the actuator to permit unobstructed movement of the actuator relative to the opening.

More preferably, the seal has a folded cross-section providing the extended length.

Further more preferably, the seal cross-section has a U-shaped bend pointing inwards.

It is preferred that the seal has an intermediate portion between the opening and the actuator, the portion being folded and having a reduced thickness.

In a preferred embodiment, the seal comprises a sleeve having opposite ends connected to the opening and the actuator respectively, a first of the ends being disposed around the corresponding one of the opening and actuator.

More preferably, the second end is also disposed around the other of the opening and actuator.

More preferably, the first end is stretched around a part forming the opening or of the actuator to which the first end is connected.

More preferably, the first end and a part forming the opening or of the actuator to which the first end is connected have complementary cross-sections mated together.

In a preferred construction, the seal comprises an inner part that is resiliently deformable and an outer part that is considerably thicker than the inner part and surrounds and protects the actuator.

More preferably, the outer part is substantially cylindrical and contains substantially wholly the inner part.

More preferably, the inner and outer parts together have a Z-folded cross-section.

The electrical switch is preferably a pushbutton switch

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 1:
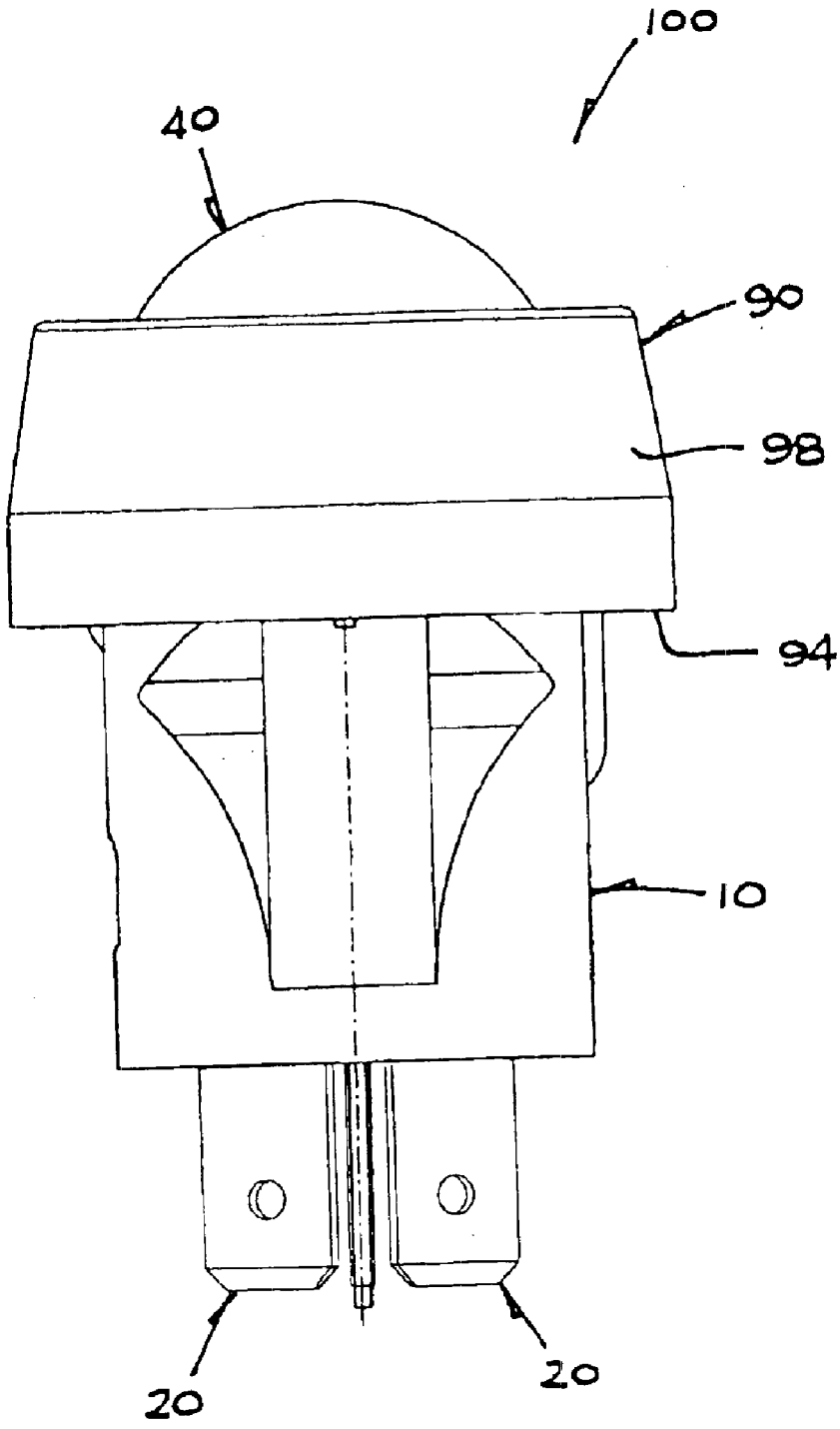
FIG. 1 is a front side view of an embodiment of an electrical switch in accordance with the invention.
Figure 2:
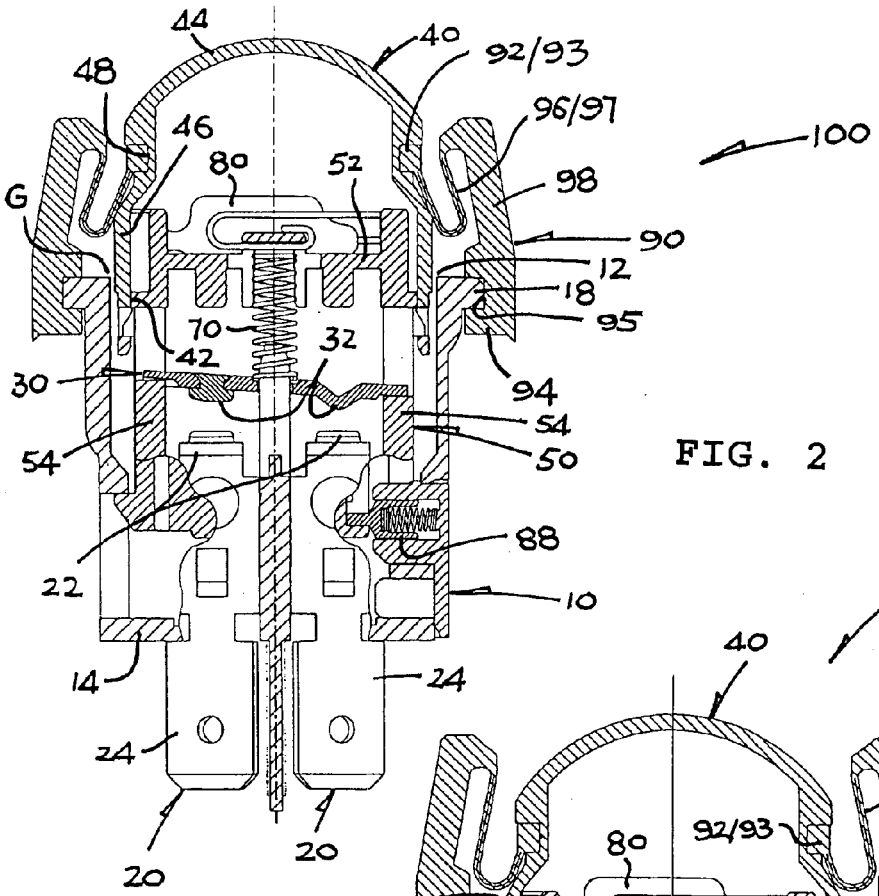
FIG. 2 is a cross-sectional front side view of the switch of FIG. 1, showing the switch open.
Figure 3:
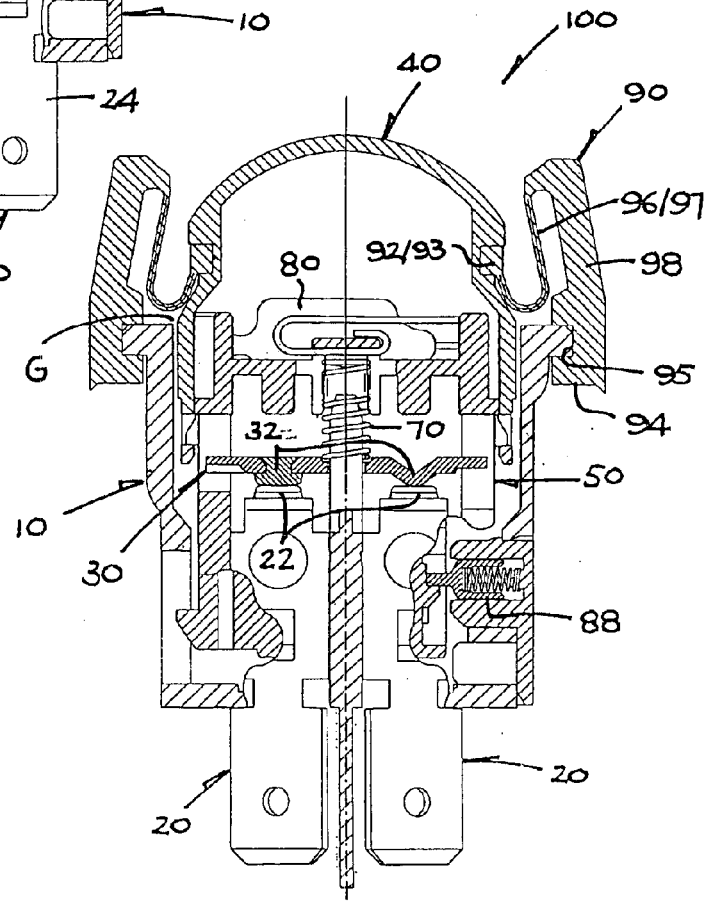
FIG. 3 is a cross-sectional view corresponding to FIG. 2, showing the switch closed.
Figure 4:
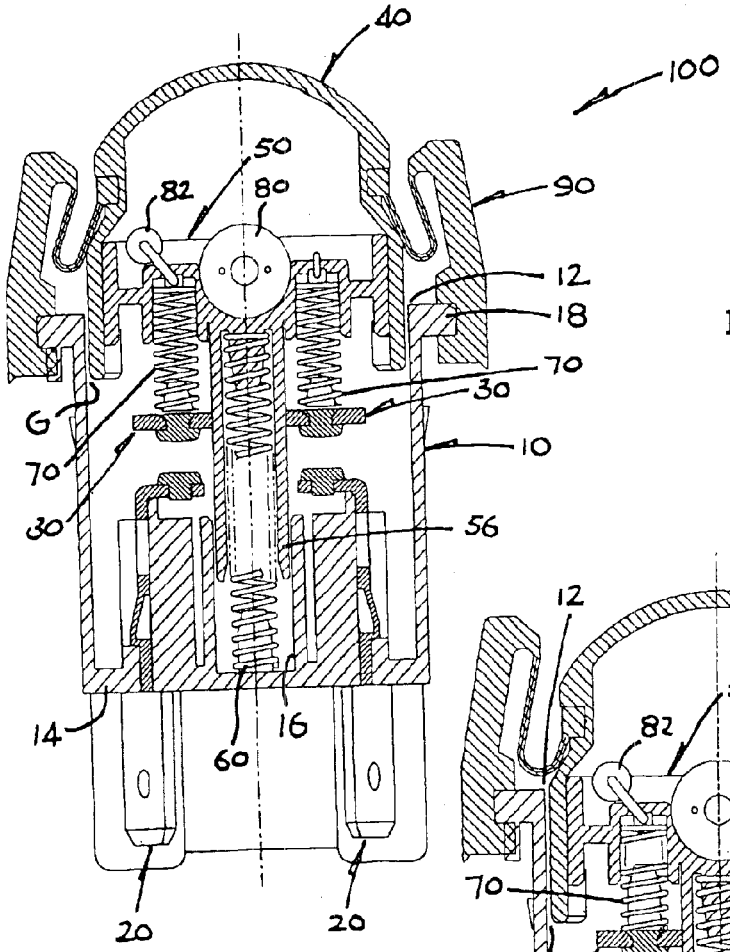
FIG. 4 is a cross-sectional left side view of the switch of FIG. 1, showing the switch open.
Figure 5:
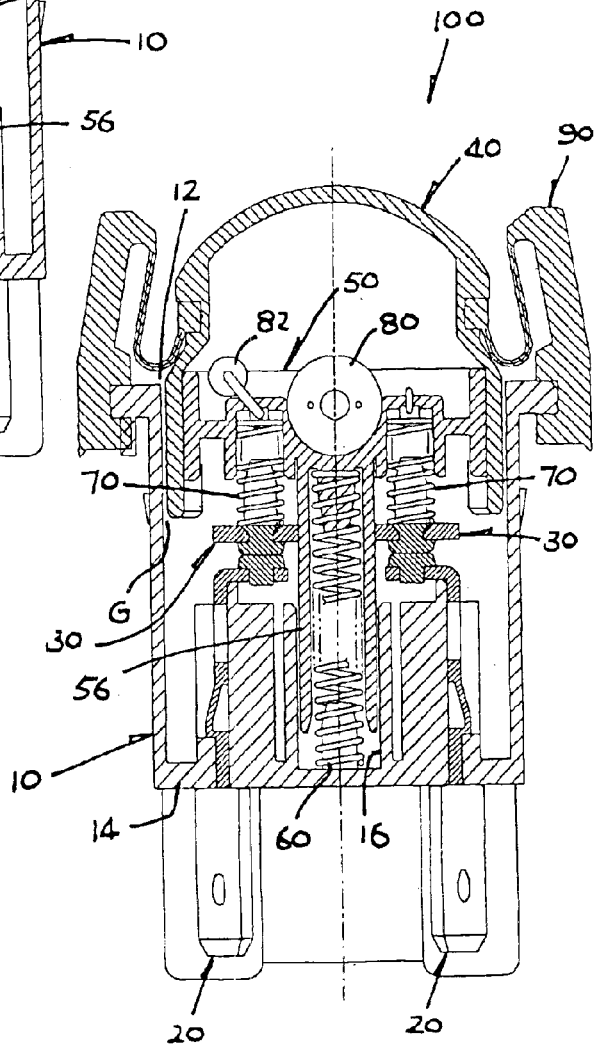
FIG. 5 is a cross-sectional view corresponding to FIG. 4, showing the switch closed.

Referring to the drawings, there is shown an electrical switch 100 embodying the invention, which is a pushbutton switch 100 having a generally cylindrical plastic housing 10, four fixed contact strips 20 located partially therein and two internal moving contact levers 30. The housing 10 has an upper end opening 12, in which a cylindrical cap-like plastic actuator 40 is co-axially disposed for manual depression. The housing 10 includes a generally closed lower end 14, through which the contact strips 20 project vertically downwardly out of the housing 10. Lower ends 24 of the contact strips 20 act as terminals for external connection to a power and load circuit. Internally, upper ends 22 of the contact strips 20 are bent to lie on the same horizontal plane.

Also included is a plastic switching member 50 supported co-axially in the housing 10 for relative upward and downward movement. The switching member 50 has an upper disc 52 extending horizontally across the interior of the housing 10, a pair of legs 54 depending from opposite sides of the disc 52, and a hollow shaft 56 depending centrally from the disc 52. The shaft 56 is received telescopically in a deep vertical central bottom hole 16 of the housing 10 for guiding thereby, inside both of which a coil spring 60 is compressed to resiliently bias the switching member 50 upwards.

The contact levers 30 are supported by the switching member 50 for movement thereby, bridging horizontally across the legs 54. Each of the contact levers 30 has opposite ends 32 arranged to come into contact with and out of contact from the upper ends 22 of a corresponding pair of the contact strips 20 below it, for switching the load on and off. The contact lever 30 is resiliently biassed downwards by a respective coil spring 70 at mid-length, for bearing against the associated contact strips 20 when the switching member 50 is sufficiently lowered.

The actuator cap 40 has a lower open end 42 that is coupled with the switching member 50 for actuating the same, encapsulating its upper disc 52. An indicator light bulb 80 and a current limiting resistor 82 therefor are mounted on the disc 52, with their terminals connected to the upper ends of respective springs 70 for in turn permanent connection to the corresponding contact levers 30 via the springs 70. The light bulb 80 is arranged to lit up upon the contact levers 30 making contact with the contact strips 20, thereby signalling that the load is switched on. The cap 40, or at least its crown part 44, is made of a transparent or preferably translucent material to reveal the signal.

In operation, upon repeated depressions, the actuator cap 40 pushes the switching member 50 inwards each time for alternately making and breaking the electrical connection between the contact levers 30 and strips 20. This is assisted by a spring-loaded catch 88 co-acting between the housing 10 and one leg 54 of the switching member 50 on one side.

The catch 88 will automatically latch and unlatch the switching member 50 upon repeated depressions of the cap 40, for holding the switching member 50 down to maintain the connection and subsequently releasing the switching member 50 to let it go back up to break the connection.

The actuator cap 40 stands out from the upper opening 12 of the housing 10, being surrounded thereby and with an annular gap G formed therebetween. The gap G is made as narrow as possible, but despite of that foreign matter such as dust or moisture may enter through the gap G into the housing 10, fouling the operation of the switch 100. To solve this problem, a sleeve-like rubber seal 90 is connected across the opening 12 and the cap 40 to seal off the gap G.

The seal 90 has an open upper end 92 that is stretched tightly around a peripheral wall 46 of the cap 40 and an open lower end 94 likewise disposed around the rim of the housing 10 that forms the opening 12 and includes an annular outer flange 18. The upper seal end 92 is thickened inwardly to form a co-extending rib 93 that mates with an annular groove 48 in the cap wall 46 of a complementary rectangular cross-section. The lower seal end 94 has an annular groove 95 in its inner surface fitting over the flange 18, the two having complementary rectangular cross-sections.

An intermediate portion 96 integrally of the seal 90 leading to the upper end 92 has a folded cross-section to form a U-shaped bend 97 pointing inwardly of the seal 90. This portion 96, while being folded and having a significantly reduced thickness, provides the seal 90 with an extended body length across the opening 12 and the cap 40 and flexibility to permit unobstructed movement of the cap 40 relative to the opening 12 or the housing 10.

The seal 90 includes a second intermediate portion 98 integrally between the first portion 96 and the lower end 94, which resembles a cylindrical collar 98 that surrounds the actuator 40 and contains wholly therein the upper end 92 and the U-shaped bend 97. The bend 97 is suspended from between the upper ends of the seal 90 and the collar 98, as shown. Taking the bend 97 and collar 98 together, the seal 90 has a double- or Z-folded cross-section.

The collar 98 is considerably thicker than the bend 97 and is sufficiently thick to be strong or robust. It protects the upper end 92 and the bend 97 and more importantly the actuator 40 at least against side impact, together being the exposed or protruding part of the switch 100 in use mounted within a wall of an electrical appliance. On the other hand, the collar 98 remains rubbery and thus safe to hit.

As its inner and outer ends 92 and 94 are simply stretched over the cap 40 and housing 10, the seal 90 can be fitted on conveniently. It is envisaged that the male/female connection at the upper and lower seal ends 92 and 94 may be swapped or made of the same type. The subject seal may be used in any other types of switches, such as rocker switch.

The invention has been given by way of example only, and various other modifications of and/or alterations to the described embodiment may be made by persons skilled in the art without departing from the scope of the invention as specified in the appended claims.

What is claimed is:

1. An electrical switch comprising a housing having an opening, a plurality of fixed contacts located in the housing, a switching member supported in the housing for movement, at least one moving contact movable by the switching member for movement to come into contact with and out of contact from the fixed contacts, and an actuator disposed in the opening for movement to actuate the switching member and in turn the moving contact, with a gap formed between the actuator and the housing, wherein a resiliently deformable seal comprising a sleeve is connected across the gap and has an inner part that is resiliently deformable, an outer part that is considerably thicker than the inner part and surrounds and protects the actuator, and opposite open ends connected to the housing and the actuator respectively, a first of the open ends being disposed around and surrounding the corresponding one of the housing and the actuator thereby sealing off the gap and avoiding entrance of foreign matter through the gap into the housing.

2. The electrical switch as claimed in claim 1, wherein the seal has an extended body length across the opening and the actuator to permit unobstructed movement of the actuator relative to the opening.

3. The electrical switch as claimed in claim 2, wherein the seal has a folded cross-section providing the extended length.

4. The electrical switch as claimed in claim 3, wherein the seal cross-section has a U-shaped bend pointing inwards.

5. The electrical switch as claimed in claim 3, wherein the seal has an intermediate portion between the opening and the actuator, the portion being folded and having a reduced thickness.

6. The electrical switch as claimed in claim 1, wherein the second open end is also disposed around the other of the housing and the actuator.

7. The electrical switch as claimed in claim 1, wherein the first open end is stretched around a part of the housing forming the opening or a part of the actuator around which the first open end is disposed.

8. The electrical switch as claimed in claim 1, wherein the first open end and a part of the housing forming the opening or a part of the actuator around which the first open end is disposed have complementary cross-sections mated together.

9. The electrical switch as claimed in claim 1, wherein the outer part is substantially cylindrical and contains substantially wholly the inner part.

10. The electrical switch as claimed in claim 1, wherein the inner and outer parts together have a Z-folded cross-section.

11. The electrical switch as claimed in claim 1, comprising a pushbutton switch.

* * * * *